US011598512B1

(12) United States Patent
Witt

(10) Patent No.: US 11,598,512 B1
(45) Date of Patent: Mar. 7, 2023

(54) DOMESTIC APPLIANCE AND LIGHT ASSEMBLY

(71) Applicant: Haier US Appliance Solutions, Inc., Wilmington, DE (US)

(72) Inventor: Daniel Witt, Lafayette, GA (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/862,533

(22) Filed: Jul. 12, 2022

(51) Int. Cl.
*F21V 19/00* (2006.01)
*F21V 21/02* (2006.01)
*F24C 15/00* (2006.01)

(52) U.S. Cl.
CPC ..... *F21V 19/0065* (2013.01); *F21V 21/02* (2013.01); *F24C 15/008* (2013.01)

(58) Field of Classification Search
CPC ..... F21V 19/0065; F21V 21/02
See application file for complete search history.

(56) References Cited

U.S. PATENT DOCUMENTS

| | | | | |
|---|---|---|---|---|
| 8,627,552 | B2 | 1/2014 | Smith et al. | |
| 9,328,930 | B2 | 5/2016 | Lin | |
| 9,976,729 | B2 | 5/2018 | Keogan | |
| 10,900,513 | B2 * | 1/2021 | Diep | F16B 21/075 |
| 2013/0235594 | A1 * | 9/2013 | Salomon | F21V 19/003 362/368 |

FOREIGN PATENT DOCUMENTS

| | | | |
|---|---|---|---|
| CN | 108488647 A | * | 9/2018 |
| EP | 0745804 B1 | * | 5/1996 |
| EP | 3508791 A1 | | 7/2019 |

OTHER PUBLICATIONS

English translation of Hao CN-108488647-A published Sep. 2018 (Year: 1996).*
English translation of Josquin EP-0745804-B1 published May 1996 (Year: 2018).*

* cited by examiner

*Primary Examiner* — Evan P Dzierzynski
(74) *Attorney, Agent, or Firm* — Dority & Manning, P.A.

(57) ABSTRACT

An appliance or light assembly may include a bulb bracket within which a light bulb is receivable and a wall panel. The bulb bracket may include a cylindrical base defining a base radius and a plurality of resilient tabs. The plurality of resilient tabs may be selectively deflectable inward. The wall panel may define an assembly aperture. The assembly aperture may include a plurality of arc segments and a plurality of expanded notches. The plurality of arc segments may be spaced apart from an aperture axis. The plurality of expanded notches may be circumferentially spaced apart by the plurality of arc segments. The plurality of expanded notches may extend outward from the plurality of arc segments. Each expanded notch may define an angular distance. Each expanded notch may include a curved segment and a blunt segment.

18 Claims, 8 Drawing Sheets

DOMESTIC APPLIANCE AND LIGHT ASSEMBLY

FIELD OF THE INVENTION

The present subject matter relates generally to domestic appliances, and more particularly to light assemblies for a domestic appliance.

BACKGROUND OF THE INVENTION

Domestic appliances, such as oven appliances, range hoods, dryer appliances, etc., often include a cabinet that defines one or more chambers. Such chambers may receive certain items or cover a set region. As a result, it is often desirable to provide one or more light assemblies to illuminate the chamber or adjacent region.

In order to mount a light assembly, many domestic appliances include wall that defines a generally circular hole or opening into which a light source (e.g., bulb) can be inserted. In the past, brackets have been provided to hold the light source within the circular opening, such as by one more spring-loaded tabs. One of the difficulties that can arise with such arrangements, though is the difficulty of assembly (e.g., during manufacture). For instance, in order to ensure sufficient clamping force is maintained for the assembled appliance, a large amount of force may be required to insert the light source and depress the spring-loaded tabs before they may expand or otherwise hold the light source in place. Assembly workers must, in turn, push the light source with a great amount of force. Many light sources are difficult to hold or repeatedly insert (e.g., on an assembly line), so specialized tools may be required to ensure an assembly worker can insert the light source through the generally circular opening (e.g., without risking damage or injury). This can complicate the manufacturing process or lead to difficulties in maintaining the appropriate fit and finish of the appliance. In extreme cases, the specialized tools may be considered cumbersome, leading some workers to expend excessive energy inserting the light source by hand.

As a result, it would be useful to provide an appliance or assembly addressing the above issues. In particular, it may be advantageous to provide an appliance or assembly for mounting a light that can be easily assembled (e.g., without the need for specialized tools or excessive force by an assembly worker).

BRIEF DESCRIPTION OF THE INVENTION

Aspects and advantages of the invention will be set forth in part in the following description, or may be obvious from the description, or may be learned through practice of the invention.

In one exemplary aspect of the present disclosure, an appliance light assembly is provided. The appliance light assembly may include a bulb bracket within which a light bulb is receivable and a wall panel. The bulb bracket may include a cylindrical base defining a base radius extending from a base axis, and a plurality of resilient tabs extending outward from the cylindrical base to a radial tab distance from the base axis. The plurality of resilient tabs may be selectively deflectable inward toward the base axis. The wall panel may define an assembly aperture within which the bulb bracket is received. The assembly aperture may include a plurality of arc segments and a plurality of expanded notches. The plurality of arc segments may be spaced apart from an aperture axis by an arc radius complementary to the base radius. The plurality of expanded notches may be circumferentially spaced apart by the plurality of arc segments. The plurality of expanded notches may extend outward from the plurality of arc segments to a radial notch distance from the aperture axis. Each expanded notch may define an angular distance from a first edge point at a first arc segment to a second edge point at a second arc segment. Each expanded notch may include a curved segment extending outward from the first edge point to the radial notch distance along a first angular portion and a blunt segment extending inward from the radial notch distance to the second edge point along a second angular portion. The first angular portion may be larger than the second angular portion.

In another exemplary aspect of the present disclosure, a domestic appliance is provided. The domestic appliance may include a cabinet and a light assembly. The cabinet may include a wall panel and define an interior chamber. The light assembly may be disposed within the interior chamber to illuminate the same. The light assembly may include a light bulb and a bulb bracket within which the light bulb is received. The bulb bracket may include a cylindrical base defining a base radius extending from a base axis, and a plurality of resilient tabs extending outward from the cylindrical base to a radial tab distance from the base axis. The plurality of resilient tabs may be selectively deflectable inward toward the base axis. The wall panel may define an assembly aperture within which the bulb bracket is received. The assembly aperture may include a plurality of arc segments and a plurality of expanded notches. The plurality of arc segments may be spaced apart from an aperture axis by an arc radius complementary to the base radius. The plurality of expanded notches may be circumferentially spaced apart by the plurality of arc segments. The plurality of expanded notches may extend outward from the plurality of arc segments to a radial notch distance from the aperture axis. Each expanded notch may define an angular distance from a first edge point at a first arc segment to a second edge point at a second arc segment. Each expanded notch may include a curved segment extending outward from the first edge point to the radial notch distance along a first angular portion and a blunt segment extending inward from the radial notch distance to the second edge point along a second angular portion. The first angular portion may be larger than the second angular portion.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
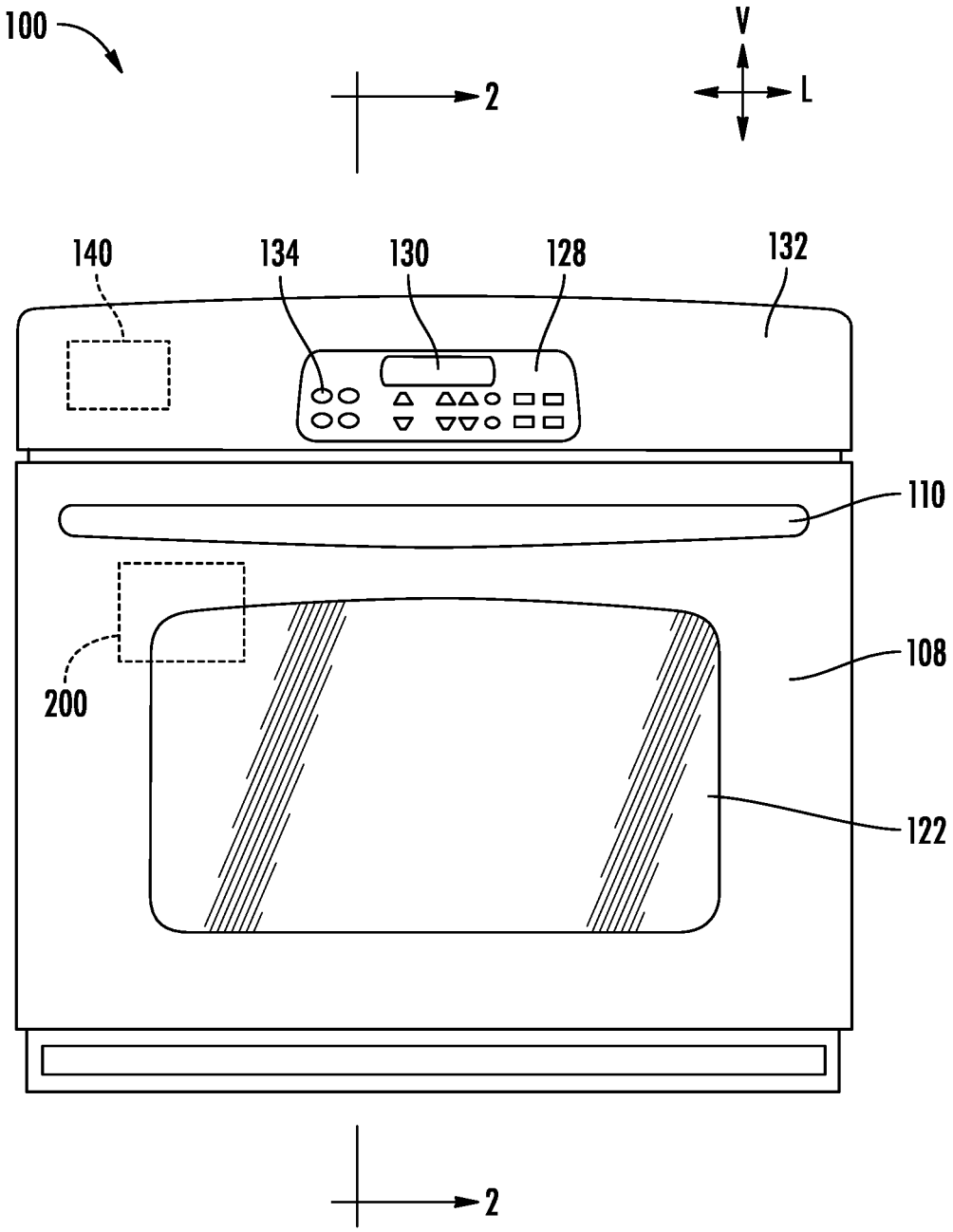
FIG. 1 provides a front perspective view of a domestic oven appliance according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V).

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
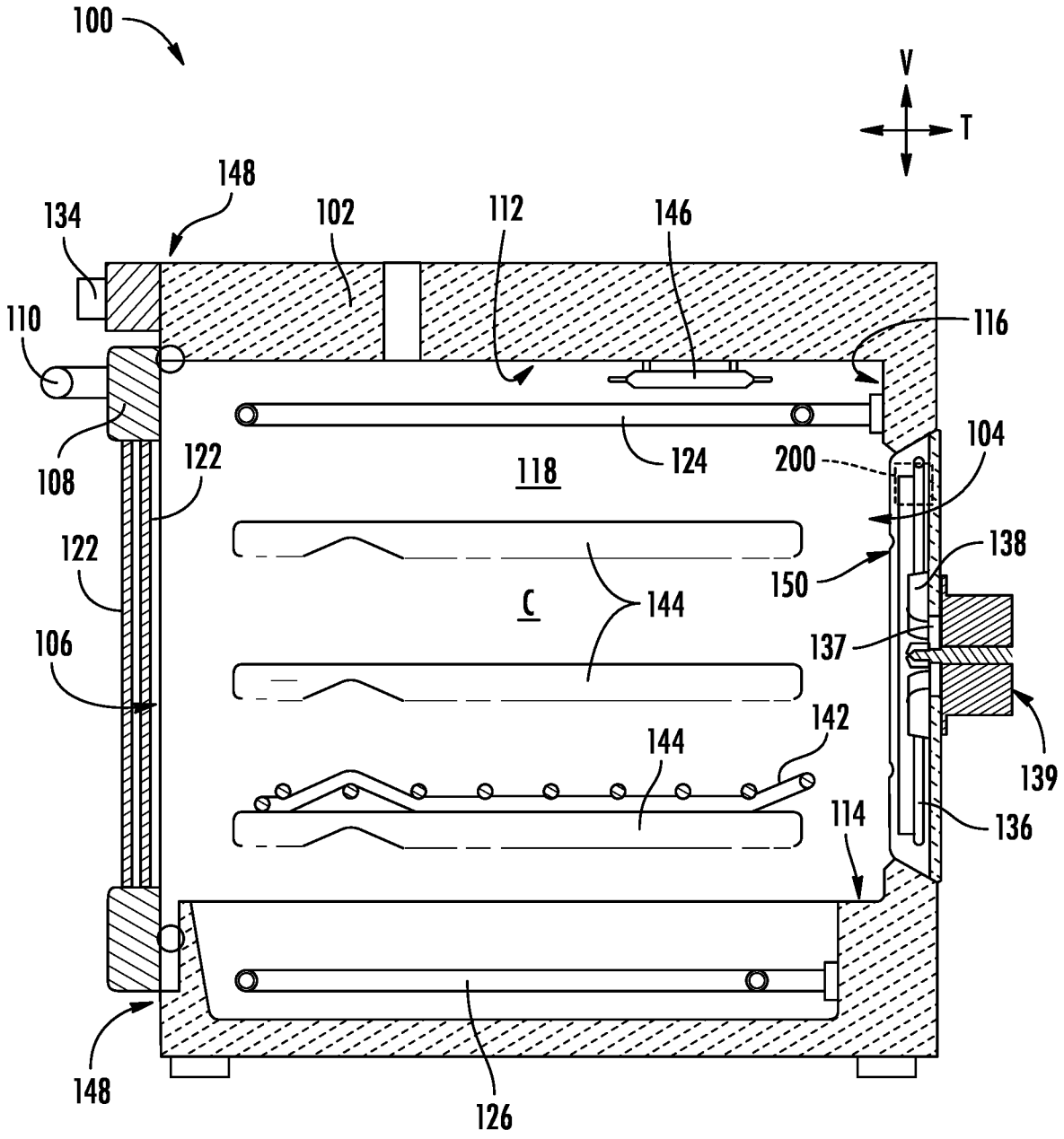
FIG. 2 provides a cross-sectional side view of the exemplary oven appliance of FIG. 1 along the line 2-2.

Referring to FIGS. 1 and 2, in exemplary embodiments, a cooking appliance or oven appliance 100 that includes an insulated cabinet 102 with an interior oven cavity 104 defined by a plurality of inner wall panels (e.g., a top wall panel 112, a bottom wall panel 114, a back wall panel 116, and opposing sidewalls 118, 120). Oven cavity 104 is configured for the receipt of one or more food items to be cooked. Oven appliance 100 includes a door 108 pivotally mounted, for example, with one or more hinges (not shown), to cabinet 102 at the opening 106 of cabinet 102 to permit selective access to oven cavity 104 through opening 106. A handle 110 is mounted to door 108 and assists a user with opening and closing door 108. For example, a user can pull on handle 110 to open or close door 108 and access oven cavity 104.

In some embodiments, a seal (e.g., gasket) is provided between door 108 and cabinet 102 that assists with maintaining heat and cooking fumes within oven cavity 104 when door 108 is closed, as shown in FIGS. 1 and 2. Multiple parallel glass panes 122 provide for viewing the contents of oven cavity 104 when door 108 is closed and assist with insulating oven cavity 104. A baking rack 142 is positioned in oven cavity 104 for the receipt of food items or utensils containing food items. Baking rack 142 is slidably received onto embossed ribs or sliding rails 144 such that rack 142 may be conveniently moved into and out of oven cavity 104 when door 108 is open.

A heating element at the top, bottom, or both of oven cavity 104 provides heat to oven cavity 104 for cooking. Such heating element(s) can be gas, electric, microwave, or a combination thereof. For example, in the embodiment shown in FIG. 2, oven appliance 100 includes a top heating element 124 and a bottom heating element 126, where bottom heating element 126 is positioned adjacent to and below bottom wall panel 114. Other configurations with or without panel 114 may be used as well.

In some embodiments, oven appliance 100 includes a convection heating element 136 and convection fan 138 positioned adjacent back wall 116 of oven cavity 104 (e.g., in fluid communication with oven cavity 104 through a fan opening 150). Convection fan 138 is powered by a convection fan motor 139. Further, convection fan 138 can be a variable speed fan. Thus, the speed (e.g., rotation speed) of fan 138 may be controlled or set anywhere between and including, for example, 0 and 100 percent. In certain embodiments, oven appliance 100 includes a bidirectional triode thyristor (not shown) [i.e., a triode for alternating current (triac)] to regulate the operation of convection fan 138 such that the speed of fan 138 may be adjusted during operation of oven appliance 100 (e.g., during a preheat or cooking cycle). Optionally, speed of convection fan 138 can be determined by, and communicated to, fan 138 by controller 140. In addition, a sensor 137, such as a rotary encoder, a Hall effect sensor, or the like, may be included at the base of fan 138, for example, between fan 138 and motor 139 as shown in the exemplary embodiment of FIG. 2, to sense the speed of fan 138. The speed of fan 138 may be measured in, for example, revolutions per minute ("RPM").

Separate from or in addition to heating elements, 124, 126, or 136, an appliance light assembly 200 may be mounted adjacent to or within oven cavity 104. For instance, light assembly 200 may be provided at back wall panel 116 or another suitable wall panel. As will be described in greater detail below, light assembly 200 generally includes at least one light source, such as an electric incandescent bulb, halogen bulb, light emitting diode (LED) bulb, fluorescent bulb, etc. (e.g., to illuminate the interior oven cavity 104).

As shown, oven appliance 100 includes a user interface 128. In some embodiments, user interface 128 has a display 130 positioned on an interface panel 132, as well as a variety of controls 134. Interface 128 allows the user to select various options for the operation of oven 100 including, for example, temperature, time, and various cooking or cleaning cycles. Operation of oven appliance 100 can be regulated by a controller 140 that is operatively coupled (i.e., in communication with) user interface 128, heating elements 124, 126, and other suitable components of oven 100.

In certain embodiments, in response to user manipulation of the user interface 128, controller 140 can operate the heating element(s). Controller 140 can receive measurements from a temperature sensor 146 placed in oven cavity 104 and, optionally, provide a temperature indication to the user with display 130.

In some embodiments, controller 140 includes a memory (e.g., non-transitive media) and one or more processing devices such as microprocessors, CPUs, or the like, such as general or special purpose microprocessors operable to execute programming instructions or micro-control code associated with operation of oven appliance 100. The memory may represent random access memory such as DRAM or read only memory such as ROM or FLASH. In one embodiment, the processor executes programming instructions stored in memory. The memory may be a separate component from the processor or may be included onboard within the processor.

Controller 140 may be positioned in a variety of locations throughout oven appliance 100. In the illustrated embodiment, controller 140 is located next to user interface 128 within interface panel 132. In other embodiments, controller 140 may be located under or next to the user interface 128 otherwise within interface panel 132 or at any other appropriate location with respect to oven appliance 100. In the embodiment illustrated in FIG. 1, input/output ("I/O") signals are routed between controller 140 and various operational components of oven appliance 100 such as heating elements 124, 126, 136, convection fan 138, controls 134, display 130, sensor 146, alarms, or other components as may be provided. In one embodiment, user interface 128 may represent a general purpose I/O ("GPIO") device or functional block.

Although shown with touch type controls 134, it should be understood that controls 134 and the configuration of oven appliance 100 shown in FIG. 1 is provided by way of example only. More specifically, user interface 128 may include various input components, such as one or more of a variety of electrical, mechanical, or electro-mechanical input devices including rotary dials, push buttons, and touch pads. User interface 128 may include other display components, such as a digital or analog display device designed to provide operational feedback to a user. User interface 128 may be in communication with controller 140 via one or more signal lines or shared communication busses.

As will be understood, oven appliance 100 is provided by way of example only, and the present subject matter may be used in any suitable domestic appliance. Thus, the present disclosure may be used with other oven, range hood, or dryer appliance configurations, as well as other suitable appliances, as would be understood in light of the present disclosure.

Turning now generally to FIGS. 3 through 8, various aspects of a light assembly 200 according to exemplary embodiments will be described in greater detail. As shown, light assembly 200 generally includes a light bulb 210 (e.g., electric incandescent bulb, halogen bulb, LED bulb, fluorescent bulb, etc., which may include a lens covering the light-generating element of the bulb) held or otherwise receivable within a bulb bracket 212. A wall panel 214 (e.g., back wall panel 116—FIG. 2) defines an assembly aperture 216 that is generally complementary to the bulb bracket 212. When assembled, the bulb bracket 212, and in turn light bulb 210, is received within assembly aperture 216. As will be described in greater detail, bulb bracket 212 may be translatably disposed within wall panel 214 and, thus, be inserted or removed (e.g., along an aperture axis AA coaxial with a base axis AB) without rotation of bulb bracket 212.

Turning especially to FIGS. 3 through 6, bulb bracket 212 includes a cylindrical base 218 that extends about a base axis AB. For instance, cylindrical base 218 may extend (e.g., continuously) along a circumferential direction C about base axis AB. As shown, cylindrical base 218 defines a base radius 220 from base axis AB. Along or parallel to the base axis AB, cylindrical base 218 may extend between a front end 222 and a rear end 224. Generally, cylindrical base 218 is hollow and may, thus, receive light bulb 210 therein (e.g., parallel to base axis AB).

At least a portion of the interior of cylindrical base 218 is matched or otherwise complementary to the exterior of light bulb 210 and may, thus, fit over light bulb 210. One or more suitable retention members or mated portions of bulb bracket 212 may serve to further hold light bulb 210 in place (e.g., by a spring or friction fit). For instance, one or more retention fingers 227 may extend inward (e.g., toward base axis AB) from base axis AB to contact or hold light bulb 210. In the illustrated embodiments, retention fingers 227 further extend rearward from rear end 224, though other suitable locations for such fingers 227 (if present) may be provided in alternative embodiments.

As shown, a plurality of resilient tabs 226 extend outward from the cylindrical base 218. Thus, the resilient tabs 226 extend further outward, as measured along the radial direction R, than the base radius 220. Specifically, the resilient tabs 226 may extend to a radial tab distance 228. In the illustrated embodiments, although resilient tabs 226 extend to radial tab distance 228, resilient tabs 226 extend at an angle that is nonparallel to the radial direction R. For instance, resilient tabs 226 may extend tangentially from cylindrical base 218.

As shown, one or more of the resilient tabs 226 may extend (e.g., as a lever) to a free end at radial tab distance 228. In turn, the free end of each resilient tab 226 may be permitted to deflect (e.g., tangentially) with respect to cylindrical base 218. Optionally, the resilient tabs 226 may be cut from portion of the material of cylindrical base 218 (e.g., spring steel) and, thus, be formed integrally as a unitary member with cylindrical base 218. In some embodiments, a rearward edge 230 (e.g., facing the rear end 224) is angled (e.g., inward) toward the base axis AB. Thus, rearward edge 230 may taper or point toward base axis AB (e.g., in comparison to the adjacent portion of resilient tab 226 or a forward edge 232). Additionally or alternatively, rearward edge 230 may be slanted (e.g., forward) such that resilient tab 226 generally extends forward from a joined end at cylindrical base 218 to the free end. Notably, the rearward edge 230 may guide resilient tab 226 to deflect inward during assembly as bulb bracket 212 passes through wall panel 214 (e.g., parallel to the aperture axis AA).

When assembled a forward edge 232 of a resilient tab 226 may contact or hold bulb bracket 212 (e.g., against a rearward surface 234 of wall panel 214). In some embodiments, a rim 238 extends outward from cylindrical base 218 (e.g., at front end 222). The rim 238 may contact or hold bulb bracket 212 (e.g., against a forward surface 236 of wall panel 214). Moreover, rim 238 may define a radius or radial distance larger than, for instance, the largest radius or radial distance of assembly aperture 216.

In certain embodiments, bulb bracket 212 further includes a rigid ridge 240 that extends outward from the cylindrical base 218. For instance, rigid ridge 240 may extend along (e.g., parallel to) the radial direction R. Rigid ridge 240 terminates at a radial ridge distance 242. Optionally, radial ridge distance 242 may be larger than radial tab distance 228 (i.e., further from base axis AB). As shown, radial ridge may be spaced apart (e.g., circumferentially) from the resilient tabs 226 and, thus, avoid contact with resilient tabs 226 as such tabs 226 deflect.

Figure 3:
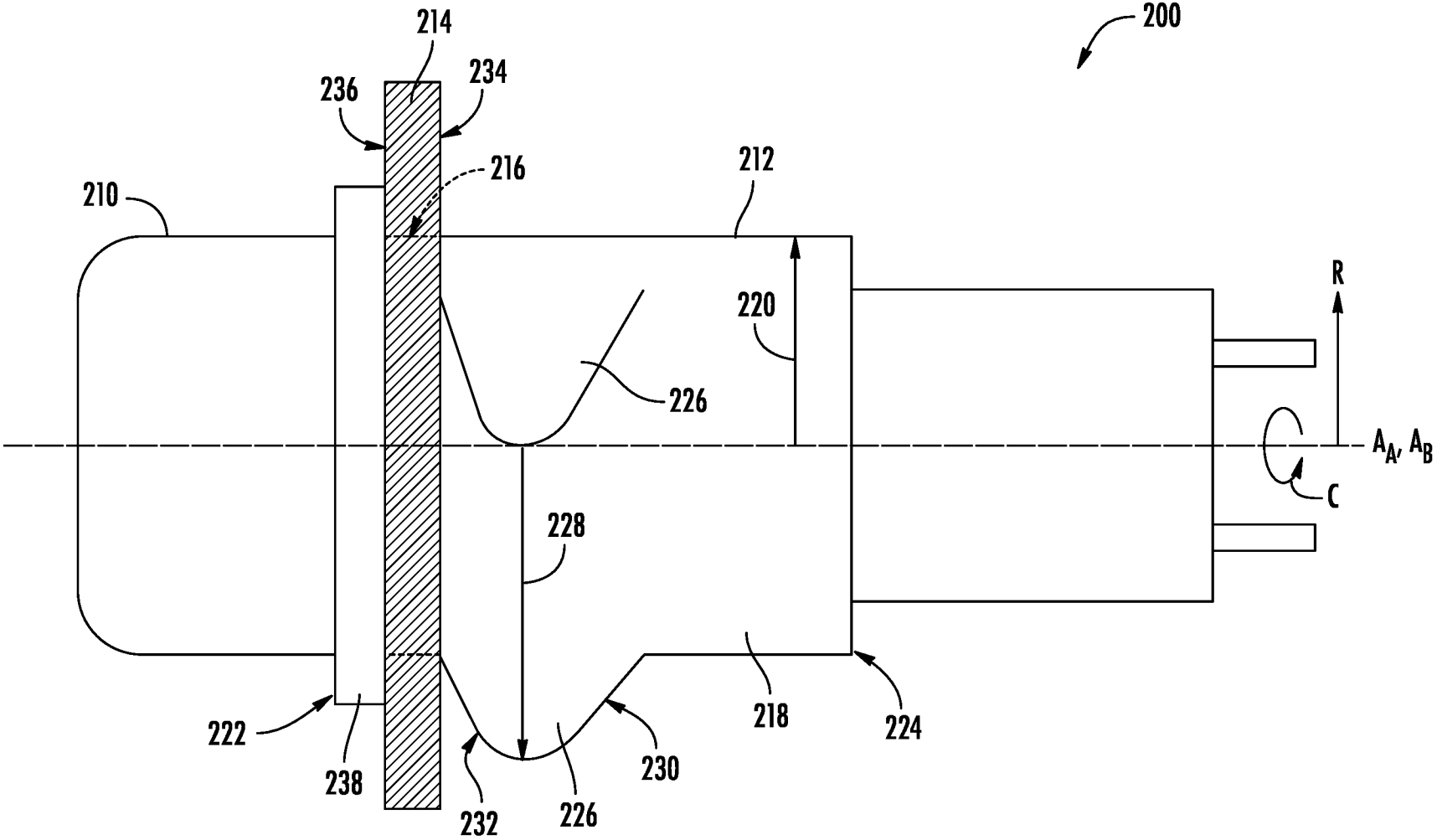
FIG. 3 provides a side view of a light assembly for a domestic appliance according to exemplary embodiments of the present disclosure.
Figure 4:
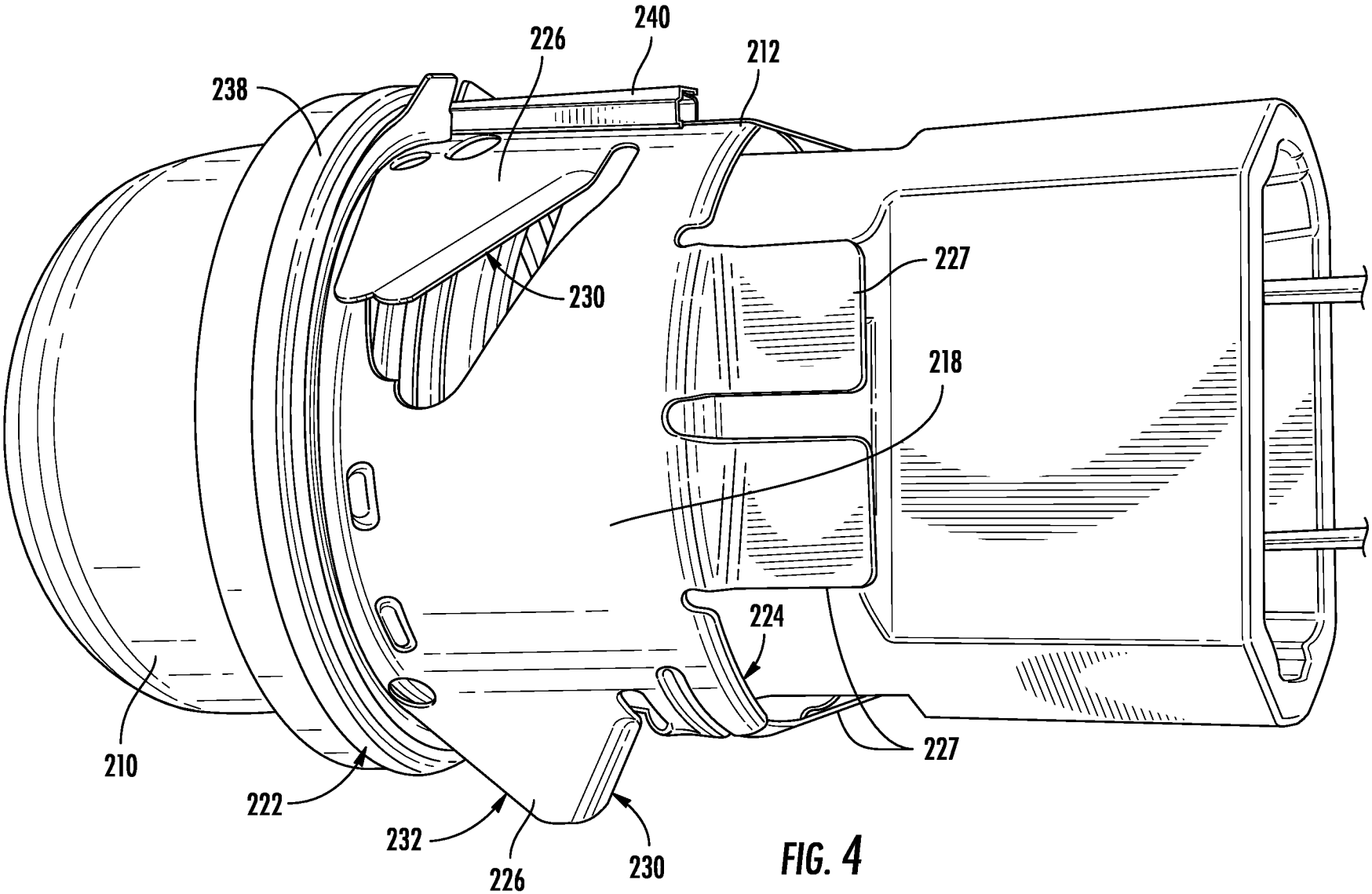
FIG. 4 provides a perspective view of a light source and bracket of the exemplary light assembly of FIG. 3.
Figure 5:
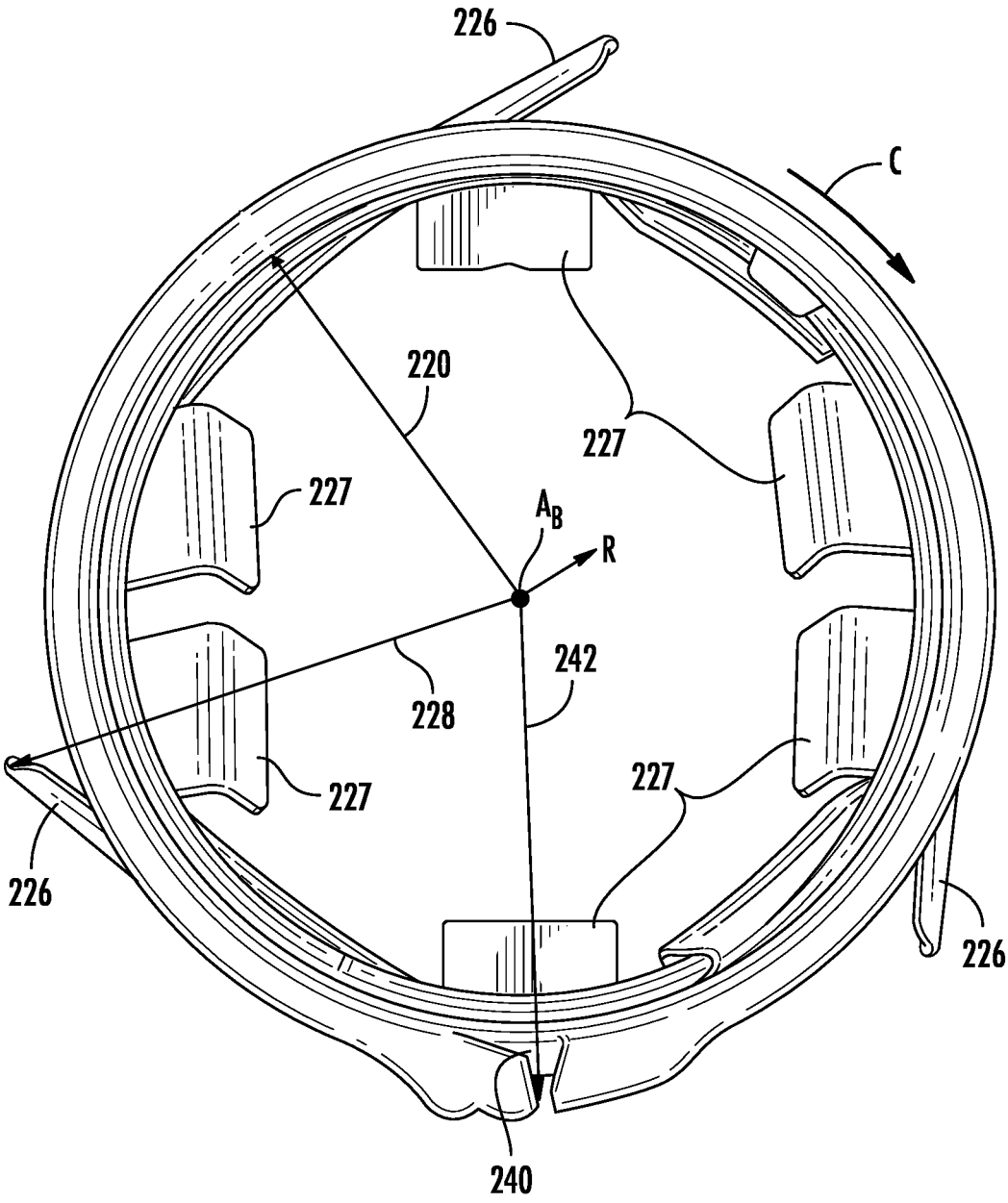
FIG. 5 provides a perspective view of the exemplary bracket along a base axis of the exemplary light assembly of FIG. 3.
Figure 6:
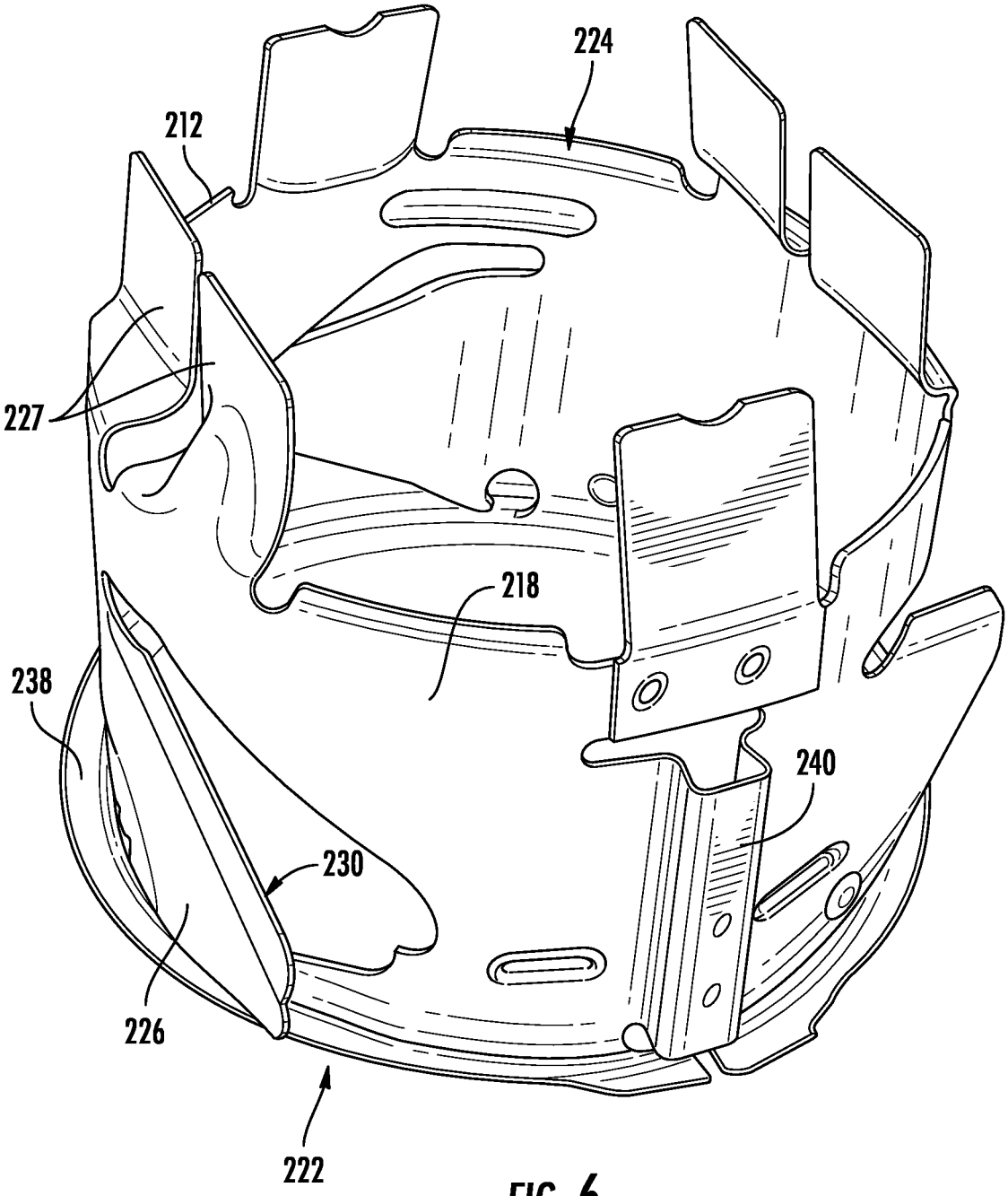
FIG. 6 provides another perspective view of the exemplary bracket along a base axis of the exemplary light assembly of FIG. 3.
Figure 7:
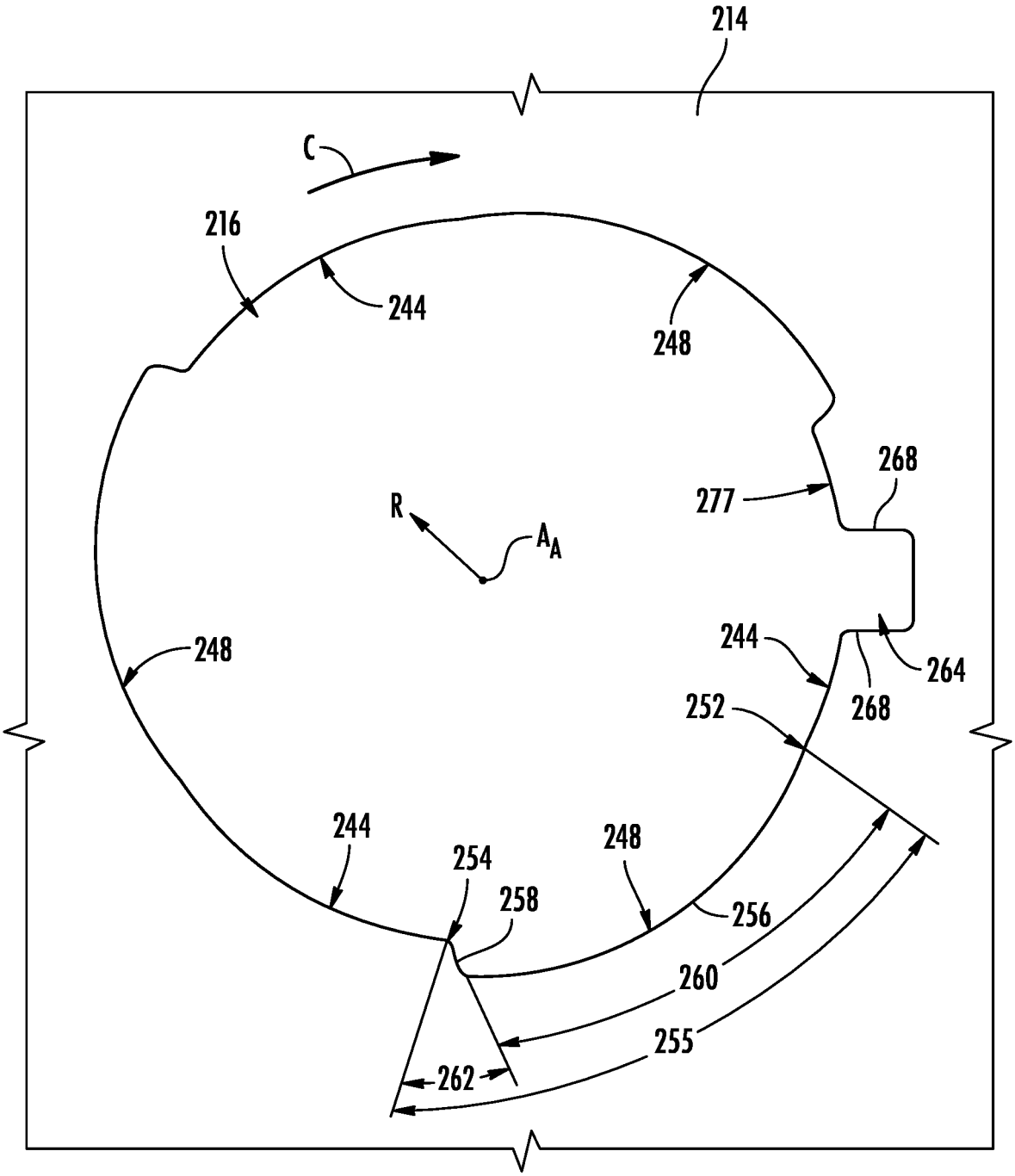
FIG. 7 provides a plan view of a wall panel along an aperture axis of the exemplary light assembly of FIG. 3.
Figure 8:
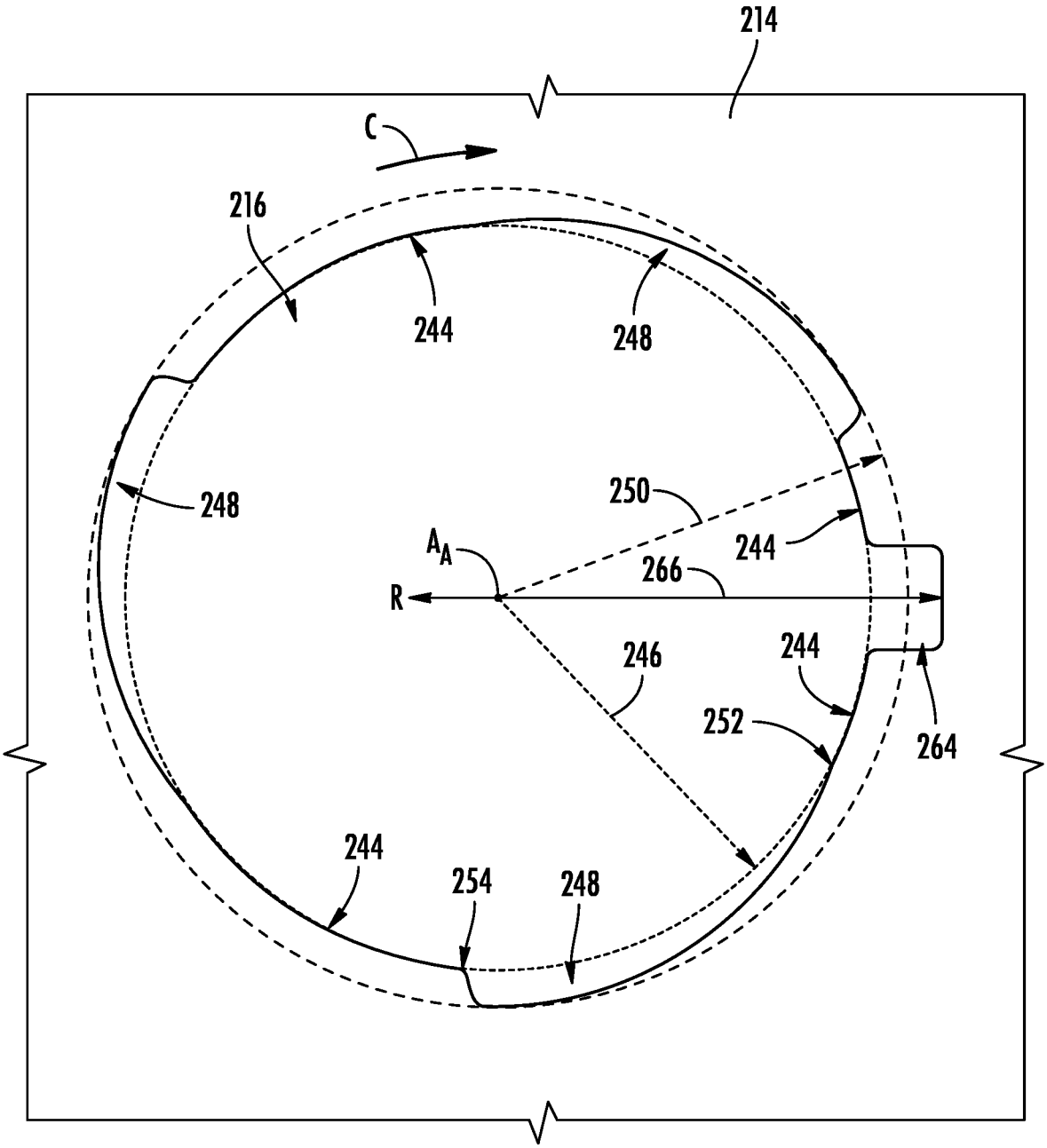
FIG. 8 provides another plan view of a wall panel along an aperture axis of the exemplary light assembly of FIG. 3.

Turning especially to FIGS. 3, 7, and 8, assembly aperture 216 is generally defined to complement at least a portion of bulb bracket 212. As shown, assembly aperture 216 extends through wall panel 214 along an aperture axis AA, which may be parallel to the received base axis AB. About aperture axis AA, assembly aperture 216 includes a plurality of arc segments 244 that extend circumferentially (i.e., along the circumferential direction C). Specifically, arc segments 244 are spaced apart from aperture axis AA by an arc radius 246. Arc radius 246 may be complementary to base radius 220 and, thus, substantially the same size while being only slightly larger to ensure base radius 220 may fit and be held within arc radius 246. In some such embodiments, arc radius 246 defines the innermost section or portion of assembly aperture 216 (i.e., section closest to aperture axis AA along the radial direction R).

Between adjacent arc segments 244, assembly aperture 216 may include a plurality of expanded notches 248. Thus, the plurality of expanded notches 248 may be circumferentially spaced apart by the plurality of arc segments 244. As shown, the plurality of expanded notches 248 extend outward from (e.g., radially outward relative to) the plurality of arc segments 244. Specifically, the expanded notches 248 may extend to a radial notch distance 250 from the aperture axis AA. The radial notch distance 250 may, thus, be greater than the arc radius 246.

Each expanded notch 248 may be formed with a multi-segment circumferential profile. For instance, each expanded notch 248 may define an angular distance 255 that extends circumferentially about a limited portion of the assembly aperture 216 (e.g., less than 360°). Specifically, an expanded notch 248 may extend from a first edge point 252 (e.g., at or adjacent to a first arc segment 244) to a second edge point 254 (e.g., at or adjacent to another or second arc segment 244). In some embodiments, expanded notch 248 includes a curved segment 256 that extends outward from the first edge point 252. Specifically, the curved segment 256 may extend radially outward along a circumferential path to the radial notch distance 250 (i.e., the maximum of the expanded notch 248). From the radial notch distance 250, expanded notch 248 may also include a blunt segment 258. The blunt segment 258 may extend inward (e.g., along a path substantially parallel to the radial direction R) to the second edge point 254. Out of the radial notch distance 250, the curved segment 256 may define a first angular portion 260 while the blunt segment 258 defines a discrete second angular portion 262. As shown, the first angular portion 260 may be larger than the second angular portion 262. Optionally, the first angular portion 260 may define more than 50% (e.g., 51%, 91%, 95%, or 99%) of the angular distance 255 of the corresponding expanded notch 248. Additionally or alternatively, the second angular portion 262 may define less than 10% (e.g., 9%, 5%, or 1%) of the angular distance 255 of each expanded notch 248.

The expanded notches 248 may be generally matched (e.g., in location and number) to the resilient tabs 226. In some embodiments, the radial notch distance 250 is less than the radial tab distance 228. In turn, during assembly, the resilient tabs 226 may align with and be deflected by the corresponding expanded notches 248 (e.g., during translation of bulb bracket 212 within assembly aperture 216).

In certain embodiments, assembly aperture 216 further includes a key slot 264 that extends outward from the arc radius 246. For instance, key slot 264 may extend along (e.g., parallel to) the radial direction R. A pair of blunt edges 268 may extend from adjacent arc segments 244. Key slot 264 may terminate at a radial slot distance 266. Optionally, slot distance 266 may be larger than radial notch distance 250 (i.e., further from aperture axis AA). Thus, the pair of blunt edges 268 may extend beyond the radial notch distance 250.

Key slot 264 may be matched and complementary to the rigid ridge 240. The radial notch distance 250 may thus be complementary to radial ridge distance 242 and, thus, substantially the same size while being only slightly larger to ensure rigid ridge 240 may fit and be held within key slot 264, thereby ensuring guided, non-rotational movement (e.g., translation) of bulb bracket 212 within assembly aperture 216.

As illustrated, the portion of wall panel 214 at which assembly aperture 216 is defined. Specifically, wall panel 214 may be flat across the assembly aperture 216. Thus, the forward surface 236 may be a planar surface at or about the assembly aperture 216. Moreover, the rearward surface 234 may be a planar surface at or about the assembly aperture 216. In turn, the portion of the wall panel 214 defining or surrounding the assembly aperture 216 may be substantially perpendicular to the aperture axis AA or otherwise free from of any expansions or embossings. Optionally, wall panel 214 may be formed of sheet metal, and assembly aperture 216 can be formed by stamping or by laser cutting.

Advantageously, assembly aperture 216 may permit easy assembly of bulb bracket 212 therein. The interaction or engagement between resilient tabs 226 and expanded notches 248 may permit the resilient tabs 226 to pass or translate along assembly aperture 216 while deflecting, yet requiring relatively little force (e.g., in comparison to a more circular opening) while ensuring resilient tabs 226 may still expand pass assembly aperture 216 and hold bulb bracket 212 against wall panel 214.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An appliance light assembly comprising:

a bulb bracket within which a light bulb is receivable, the bulb bracket comprising a cylindrical base defining a base radius extending from a base axis, and a plurality of resilient tabs extending outward from the cylindrical base to a radial tab distance from the base axis, the plurality of resilient tabs being selectively deflectable inward toward the base axis; and a wall panel defining an assembly aperture within which the bulb bracket is received, the assembly aperture comprising a plurality of arc segments spaced apart from an aperture axis by an arc radius complementary to the base radius, and a plurality of expanded notches circumferentially spaced apart by the plurality of arc segments, the plurality of expanded notches extending outward from the plurality of arc segments to a radial notch distance from the aperture axis, each expanded notch defining an angular distance from a first edge point at a first arc segment to a second edge point at a second arc segment, wherein each expanded notch comprises a curved segment extending outward from the first edge point to the radial notch distance along a first angular portion and a blunt segment extending inward from the radial notch distance to the second edge point along a second angular portion, the first angular portion being larger than the second angular portion.

2. The appliance light assembly of claim 1, wherein the bulb bracket is translatably disposed within the wall panel.

3. The appliance light assembly of claim 1, wherein the bulb bracket further comprises a rigid ridge extending outward from the cylindrical base to a radial ridge distance from the base axis apart from the plurality of resilient tabs, and wherein the assembly aperture further comprises a key slot extending outward from the arc radius to receive the rigid ridge.

4. The appliance light assembly of claim 3, wherein the key slot comprises a pair of blunt edges extending beyond the radial notch distance.

5. The appliance light assembly of claim 1, wherein each tab of the plurality of resilient tabs extends from a circumference of the cylindrical base at a non-parallel angle relative to a radial direction extending from the base axis.

6. The appliance light assembly of claim 5, wherein each tab comprises a rearward edge angled inward toward the base axis.

7. The appliance light assembly of claim 1, wherein the first angular portion defines more than 50% of the angular distance of each expanded notch.

8. The appliance light assembly of claim 7, wherein the second angular portion defines less than 10% of the angular distance of each expanded notch.

9. The appliance light assembly of claim 1, wherein the wall panel is flat across the assembly aperture.

10. A domestic appliance comprising:

a cabinet comprising a wall panel and defining an interior chamber; and a light assembly disposed within the interior chamber to illuminate the same, the light assembly comprising:

a light bulb; and a bulb bracket within which the light bulb is received, the bulb bracket comprising a cylindrical base defining a base radius extending from a base axis, and a plurality of resilient tabs extending outward from the cylindrical base to a radial tab distance from the base axis, the plurality of resilient tabs being selectively deflectable inward toward the base axis, wherein wall panel defines an assembly aperture within which the bulb bracket is received, the assembly aperture comprising a plurality of arc segments spaced apart from an aperture axis by an arc radius complementary to the base radius, and a plurality of expanded notches circumferentially spaced apart by the plurality of arc segments, the plurality of expanded notches extending outward from the plurality of arc segments to a radial notch distance from the aperture axis, each expanded notch defining an angular distance from a first edge point at a first arc segment to a second edge point at a second arc segment, wherein each expanded notch comprises a curved segment extending outward from the first edge point to the radial notch distance along a first angular portion and a blunt segment extending inward from the radial notch distance to the second edge point along a second angular portion, the first angular portion being larger than the second angular portion.

11. The domestic appliance of claim 10, wherein the bulb bracket is translatably disposed within the wall panel.

12. The domestic appliance of claim 10, wherein the bulb bracket further comprises a rigid ridge extending outward from the cylindrical base to a radial ridge distance from the base axis apart from the plurality of resilient tabs, and wherein the assembly aperture further comprises a key slot extending outward from the arc radius to receive the rigid ridge.

13. The domestic appliance of claim 12, wherein the key slot comprises a pair of blunt edges extending beyond the radial notch distance.

14. The domestic appliance of claim 10, wherein each tab of the plurality of resilient tabs extends from a circumference of the cylindrical base at a non-parallel angle relative to a radial direction extending from the base axis.

15. The domestic appliance of claim 14, wherein each tab comprises a rearward edge angled inward toward the base axis.

16. The domestic appliance of claim 10, wherein the first angular portion defines more than 50% of the angular distance of each expanded notch.

17. The domestic appliance of claim 16, wherein the second angular portion defines less than 10% of the angular distance of each expanded notch.

18. The domestic appliance of claim 10, wherein the wall panel is flat across the assembly aperture.

* * * * *